US008169274B2

(12) United States Patent
Tahara et al.

(10) Patent No.: US 8,169,274 B2
(45) Date of Patent: May 1, 2012

(54) TRANSMISSION LINE CONVERTER USING OBLIQUE COUPLING SLOTS DISPOSED IN THE NARROW WALL OF A RECTANGULAR WAVEGUIDE

(75) Inventors: Yukihiro Tahara, Tokyo (JP); Hideyuki Oh-Hashi, Tokyo (JP); Tetsuya Ohba, Tokyo (JP); Satoshi Yamaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 178 days.

(21) Appl. No.: 12/664,127

(22) PCT Filed: Jul. 5, 2007

(86) PCT No.: PCT/JP2007/063444

§ 371 (c)(1),
(2), (4) Date: Dec. 11, 2009

(87) PCT Pub. No.: WO2009/004729

PCT Pub. Date: Jan. 8, 2009

(65) Prior Publication Data

US 2010/0176894 A1 Jul. 15, 2010

(51) Int. Cl.
*H01P 5/107* (2006.01)

(52) U.S. Cl. ..... 333/26; 333/248

(58) Field of Classification Search ..... 333/26, 333/248, 113, 114, 237

See application file for complete search history.

(56) References Cited

U.S. PATENT DOCUMENTS 2,914,766 A * 11/1959 Butler ..... 343/771
2,976,499 A 3/1961 Sferrazza
3,106,713 A * 10/1963 Murata et al. ..... 343/770
3,795,915 A * 3/1974 Yoshida ..... 343/771
4,433,313 A 2/1984 Saint et al.
4,458,217 A 7/1984 Wong et al.
5,724,049 A 3/1998 Park et al.
6,081,241 A 6/2000 Josefsson et al.
6,509,809 B1 1/2003 Lynch
2003/0107459 A1 6/2003 Takahashi et al.
2005/0163456 A1 7/2005 Munk

FOREIGN PATENT DOCUMENTS

JP 49 74463 7/1974

(Continued)

OTHER PUBLICATIONS

Japanese Office Action issued Sep. 6, 2011, in Patent Application No. 2009-521489.

*Primary Examiner* — Benny Lee
(74) *Attorney, Agent, or Firm* — Oblon, Spivak, McClelland, Maier & Neustadt, L.L.P.

(57) ABSTRACT

It is an object to obtain a transmission line converter in which a rectangular waveguide provided under a transmission line may be reduced in size. In the transmission line converter including: a rectangular waveguide (11); a slot (5) provided in a wall surface of the rectangular waveguide (11); and a transmission line (13) which extends in a direction of a tube axis of the rectangular waveguide (11) and includes signal conductors (2 and 3) and a ground conductor (4), the slot (5) is provided in a narrower wall surface of the rectangular waveguide (11) and has a shape in which a central portion of the slot (5) includes an oblique portion to the tube axis of the rectangular waveguide (11) and at least one of both end portions of the oblique portion includes a portion parallel to the tube axis of the rectangular waveguide (11), and the wall surface of the rectangular waveguide (11) in which the slot (5) is provided is a part of the ground conductor (4).

8 Claims, 6 Drawing Sheets

FOREIGN PATENT DOCUMENTS

| | | | |
|---|---|---|---|
| JP | 58 129803 | | 8/1983 |
| JP | 3 219702 | | 9/1991 |
| JP | 8-84005 | | 3/1996 |
| JP | 8-148913 | A | 6/1996 |
| JP | 10 107518 | | 4/1998 |
| JP | 10-107518 | | 4/1998 |
| JP | 2007-74646 | A | 3/2007 |
| WO | WO 98/54782 | A1 | 12/1998 |

* cited by examiner

TRANSMISSION LINE CONVERTER USING OBLIQUE COUPLING SLOTS DISPOSED IN THE NARROW WALL OF A RECTANGULAR WAVEGUIDE

TECHNICAL FIELD

The present invention relates to a transmission line converter mainly including: a waveguide used in a microwave band or a millimeter wave band; and a transmission line formed of a microstrip line, a strip line, a coaxial line, or the like, and more particularly, to a transmission line converter using a rectangular waveguide as a waveguide.

BACKGROUND ART

A waveguide/microstrip line converter has been widely used to convert and transmit a high-frequency signal between a waveguide and a microstrip line. In particular, according to a structure of a conventional waveguide/microstrip line converter used in a high-frequency band such as a millimeter wave band, a slot is provided in a tube wall of the waveguide and electromagnetically coupled to the microstrip line (see, for example, Patent Document 1).

The waveguide/microstrip line converter as described in Patent Document 1 has a structure in which the slot is provided in a direction perpendicular to a tube axis in the tube wall of the waveguide which is perpendicular to an electric field, the microstrip line is provided along the tube wall so as to be orthogonal to the slot, and the slot and the microstrip line are electromagnetically coupled to each other.

Patent Document 1: JP 09-246816 A

SUMMARY OF THE INVENTION

Problem to be Solved by the Invention

However, a conventional technology has the following problem. In the conventional waveguide/microstrip line converter as described in Patent Document 1, the slot is provided in the tube wall of the waveguide which is perpendicular to the electric field, that is, in a wide wall surface. Therefore, an area in which the wide wall surface of the waveguide is provided is required under the microstrip line, and hence it is difficult to reduce the size thereof.

The present invention has been made to solve the problem as described above. It is an object of the present invention to obtain a transmission line converter in which the waveguide provided under the transmission line may be reduced in size.

Means for Solving the Problem

According to the present invention, there is provided a transmission line converter including: a rectangular waveguide; a slot provided in a wall surface of the rectangular waveguide; and a transmission line which extends in a direction of a tube axis of the waveguide and includes a signal conductor and a ground conductor, in which the slot is provided in the wall surface with a narrower width, of the rectangular waveguide and has a shape in which a central portion of the slot includes an oblique portion to the tube axis of the rectangular waveguide and at least one of both end portions of the oblique portion includes a portion parallel to the tube axis of the rectangular waveguide, and in which the wall surface of the rectangular waveguide in which the slot is provided is a part of the ground conductor.

Effects of the Invention

According to the present invention, the slot provided in the wall surface with the narrower width (narrow wall surface), of the rectangular waveguide is formed into the shape in which the central portion includes the oblique portion to the tube axis of the rectangular waveguide (that is, portion in which central portion crosses tube axis of rectangular waveguide at an angle which is not zero degrees) and at least one of the end portions of the oblique portion includes a portion parallel to the tube axis of the rectangular waveguide. The slot having the shape as described above is provided in the position in which the respective currents are maximum on the narrow wall surface of the rectangular waveguide and the ground conductor pattern of the transmission line, so as to block current from flowing through the ground conductor pattern. Therefore, a transmission line converter may be obtained, in which the waveguide provided under the transmission line is reduced in size.

BEST MODE FOR CARRYING OUT THE INVENTION

Hereinafter, transmission line converters according to preferred embodiments of the present invention are described with reference to the attached drawings. Like features in the different drawing figures are designated by the same reference number, and may not be described in detail in all drawing figures in which they appear.

Embodiment 1

Figure 1:
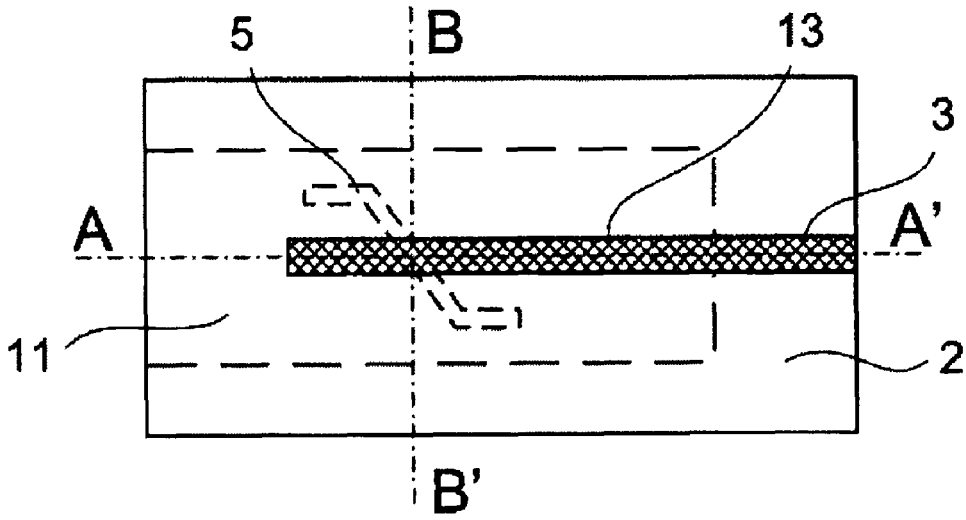
FIG. 1 is a top view illustrating a transmission line converter according to Embodiment 1 of the present invention.
Figure 2:
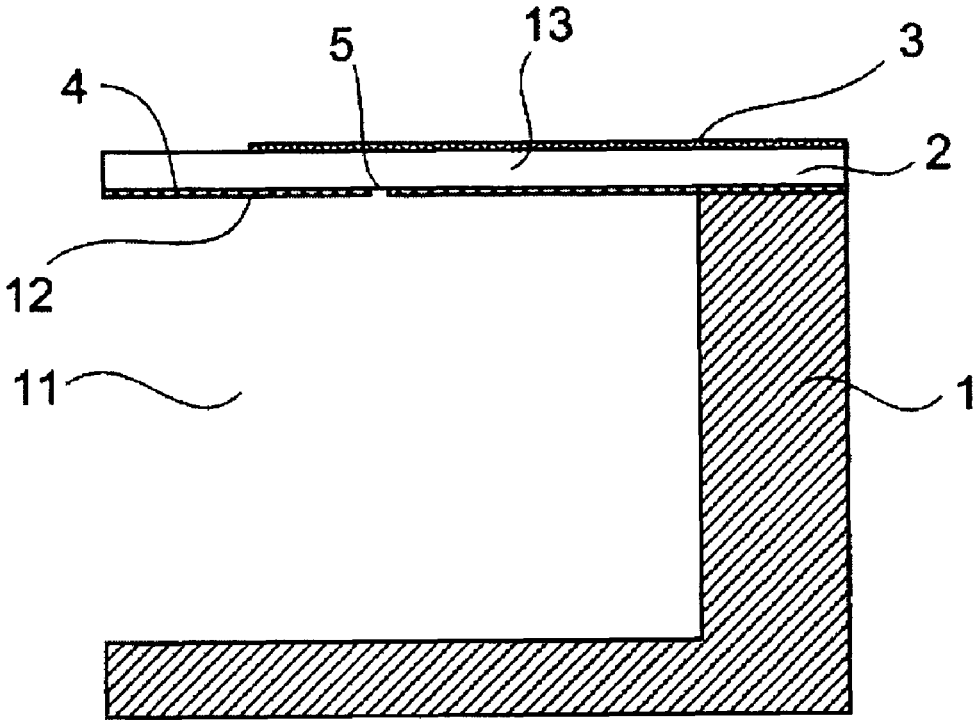
FIG. 2 is a cross sectional view taken along the line A-A', for illustrating the transmission line converter of FIG. 1 according to Embodiment 1 of the present invention.
Figure 3:
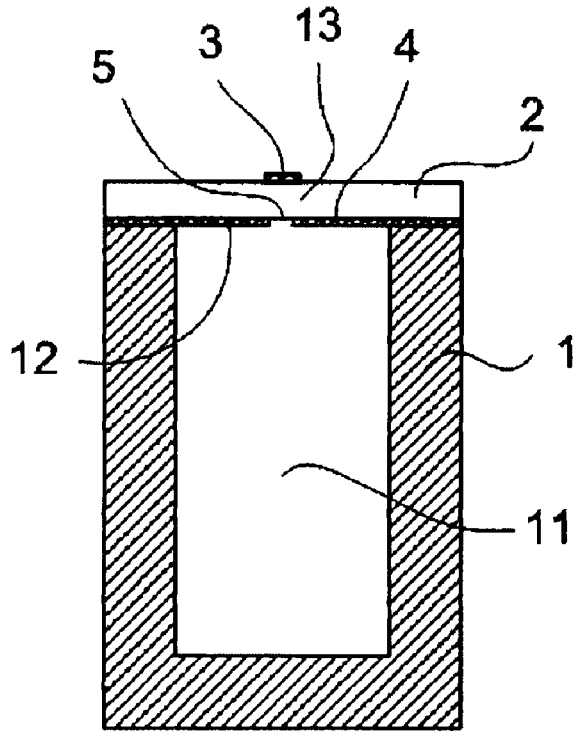
FIG. 3 is a cross sectional view taken along the line B-B', for illustrating the transmission line converter of FIG. 1 according to Embodiment 1 of the present invention.

FIG. 1 is a top view illustrating a transmission line converter according to Embodiment 1 of the present invention. FIG. 2 is a cross sectional view taken along the line A-A', for illustrating the transmission line converter of FIG. 1 according to Embodiment 1 of the present invention. FIG. 3 is a cross sectional view taken along the line B-B', for illustrating the transmission line converter of FIG. 1 according to Embodiment 1 of the present invention. Embodiment 1 of the present invention describes a converter between a rectangular waveguide and a microstrip line in a case where the microstrip line is used as a transmission line.

The transmission line converter illustrated in FIGS. 1 to 3 includes a metal chassis 1 (FIGS. 2 and 3), a dielectric board 2, a strip conductor pattern 3, a ground conductor pattern 4 (FIGS. 2 and 3), and a slot 5. The metal chassis 1 is provided with an excavated portion. The strip conductor pattern 3 is provided on a front surface of the dielectric board 2. The ground conductor pattern 4 is provided on a rear surface of the dielectric board 2. The ground conductor pattern 4 is provided with the slot 5.

The metal chassis 1 and the dielectric board 2 are stacked on each other such that the ground conductor pattern 4 is in contact with the metal chassis 1, and thus constitute a rectangular waveguide 11. The ground conductor pattern 4 forms a narrow wall surface 12 (FIGS. 2 and 3) of the rectangular waveguide 11. The dielectric board 2, the strip conductor pattern 3, and the ground conductor pattern 4 constitute a microstrip line 13.

A structure is obtained in which one end of the rectangular waveguide 11 is short-circuited at a position which is separated approximately ¼ times a guide wavelength of the rectangular waveguide 11 from the position in which the slot 5 is provided. In contrast to this, a structure is obtained in which one end of the microstrip line 13 is open-circuited at a position which is separated approximately ¼ times a propagation wavelength of the microstrip line 13 from the position in which the slot 5 is provided.

The slot 5 is formed into a bent shape such that a central portion thereof includes an oblique portion which is not parallel to a tube axis direction of the rectangular waveguide 11 and has a certain angle with respect thereto (that is, portion in which central portion crosses tube axis of rectangular waveguide 11 at an angle which is not zero degrees) and both end portions thereof are parallel to the tube axis direction (see shape of slot 5 which is indicated by broken line of FIG. 1). A length of the entire slot 5 is approximately ½ times a wavelength.

Next, an operation of the transmission line converter according to Embodiment 1 is described.

A high-frequency signal input to the rectangular waveguide 11 propagates in the TE10 mode which is the fundamental mode of the waveguide, and hence a current flows through the narrow wall surface 12 of the rectangular waveguide 11 in a direction perpendicular to the tube axis. One end of the rectangular waveguide 11 is short-circuited, and hence the current flowing through the narrow wall surface 12 is maximum in the position of the slot 5 corresponding to the position which is separated approximately ¼ times the guide wavelength from the short-circuit surface.

Figure 4:
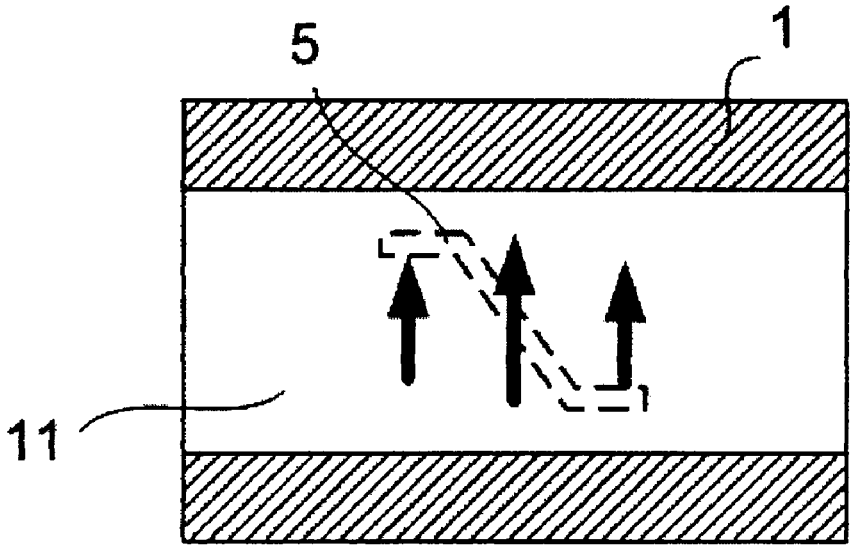
FIG. 4 is an explanatory view illustrating a state in which a current flowing through a narrow wall surface is maximum in a position of a slot in Embodiment 1 of the present invention.

FIG. 4 is an explanatory view illustrating a state in which the current (designated by the arrows) flowing through the narrow wall surface 12 (FIGS. 2 and 3) is maximum in the position of the slot 5 in Embodiment 1 of the present invention. As illustrated in FIG. 4, the slot 5 is provided so as to block the current from flowing through the narrow wall surface 12 and the length of the slot is approximately ½ wavelength. As a result, the high-frequency signal that has propagated through the rectangular waveguide 11 is coupled to the slot 5, and hence the slot 5 resonates.

In contrast to this, a ground current of the high-frequency signal propagating through the microstrip line 13 flows parallel to a transmission direction of the microstrip line 13. One end of the microstrip line 13 is open-circuited, and hence the current flowing through the ground conductor pattern 4 is maximum in the position of the slot 5 corresponding to the position which is separated approximately ¼ times the propagation wavelength from the open end.

Figure 5:
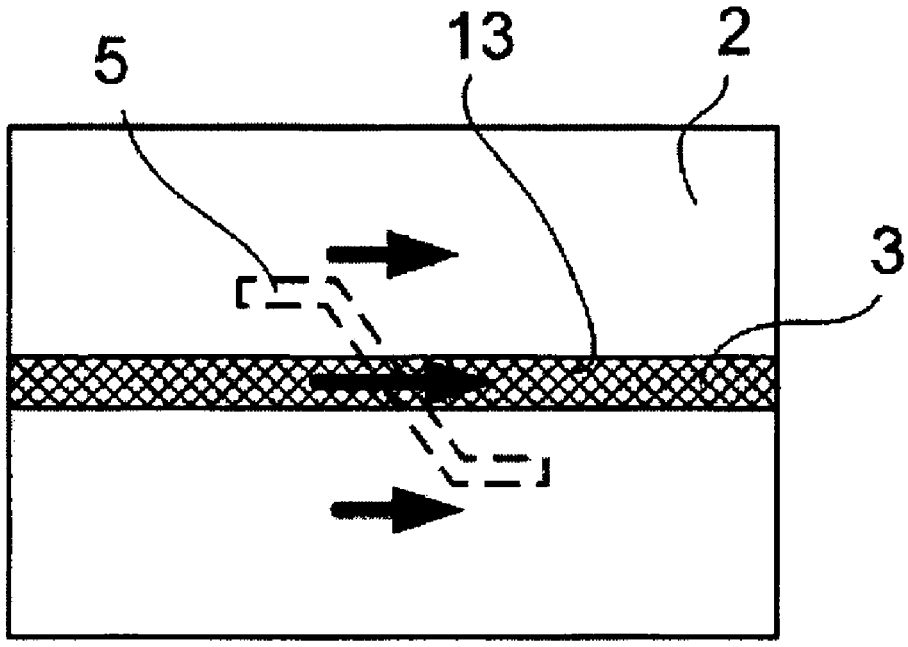
FIG. 5 is an explanatory view illustrating a state in which a current flowing through a ground conductor pattern is maximum in a position of the slot in Embodiment 1 of the present invention.

FIG. 5 is an explanatory view illustrating a state in which the current (designated by the arrows) flowing through the ground conductor pattern 4 (FIGS. 2 and 3) is maximum in the position of the slot 5 in Embodiment 1 of the present invention. As illustrated in FIG. 5, the central portion of the slot 5 blocks the current from flowing through the ground conductor pattern 4, and hence the high-frequency signal is coupled from the resonant slot 5 to the microstrip line 13.

Therefore, the high-frequency signal that has propagated through the rectangular waveguide 11 (FIGS. 1-3) is coupled to the microstrip line 13 through the slot 5 and thus may propagate through the microstrip line 13 without reflection.

As described above, according to Embodiment 1, the slot having the bent shape is provided in the position in which the respective currents are maximum on the narrow wall surface of the rectangular waveguide and the ground conductor pattern of the microstrip line, so as to block current from flowing through the ground conductor pattern 4. Therefore, the high-frequency signal is coupled between the rectangular waveguide and the microstrip line through the slot and thus may propagate without reflection.

With regard to the bent shape of the slot provided in the narrow wall surface of the rectangular waveguide, the central portion includes the oblique portion to the tube axis of the rectangular waveguide and both end portions include portions parallel to the tube axis of the rectangular waveguide, and hence the microstrip line may be provided on the narrow wall surface of the rectangular waveguide in the tube axis direction. Therefore, as compared with a case where the slot is provided in the rectangular waveguide in a direction perpendicular to an electric field, a small-size transmission line converter in which an area required to provide the slot is reduced may be obtained.

The example illustrated in FIGS. 1 to 3 in Embodiment 1 of the present invention corresponds to the case where both ends of the slot 5 are bent with respect to the central portion. However, even when only one end is bent to provide the slot parallel to the tube axis direction, the same effect as in the case where both ends are bent may be obtained. The slot 5 may have not only the shape obtained by bending the straight line but also a curved shape.

The definition "the shape in which at least one of the end portions includes the portion parallel to the tube axis of the rectangular waveguide" is not limited to the bending direction of the end portions of the slot as illustrated in FIG. 1. Even when the end portions are bent in opposite directions by 180 degrees (that is, even when end portions are bent such that entire slot is formed into Z-shape), the same effect may be obtained.

An angle of the central portion of the slot with respect to the tube axis direction may be arbitrarily selected within a range of from a value larger than 0 degrees to a value smaller than 180 degrees. When the angle is adjusted depending on the shape of the rectangular waveguide, the shape of the microstrip line, and impedances of those, impedance matching between the rectangular waveguide and the microstrip line may be realized.

Embodiment 2

Embodiment 1 describes the converter between the rectangular waveguide and the microstrip line in the case where the microstrip line is used as the transmission line. In contrast to this, Embodiment 2 of the present invention describes a converter between the rectangular waveguide and a rectangular coaxial line in a case where the rectangular coaxial line is used as the transmission line.

Figure 6:
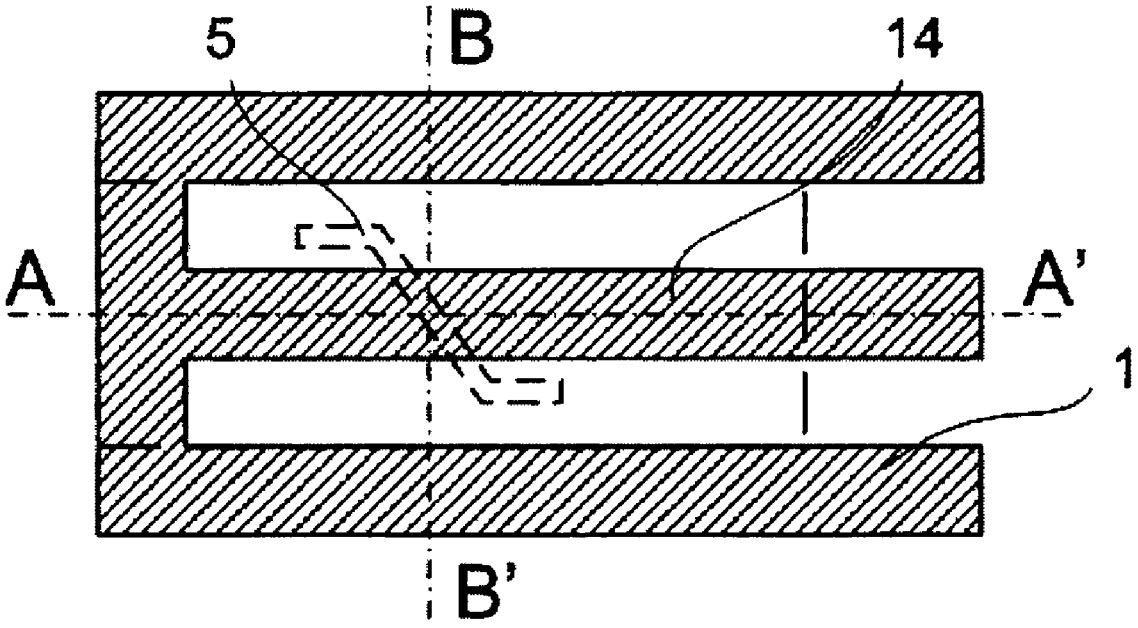
FIG. 6 is a cross sectional view illustrating a transmission line converter according to Embodiment 2 of the present invention.
Figure 7:
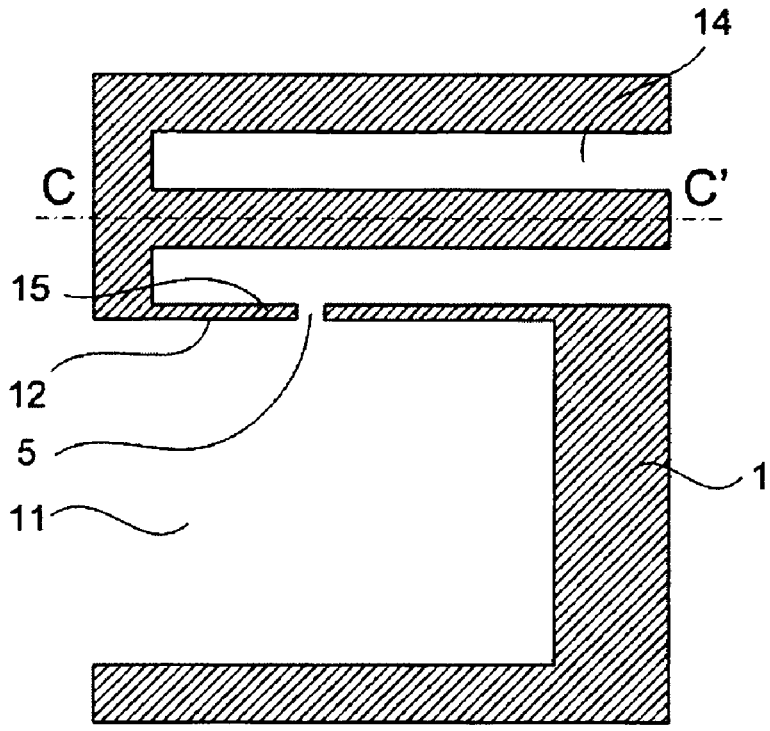
FIG. 7 is a cross sectional view taken along the line A-A', for illustrating the transmission line converter of FIG. 6 according to Embodiment 2 of the present invention.
Figure 8:
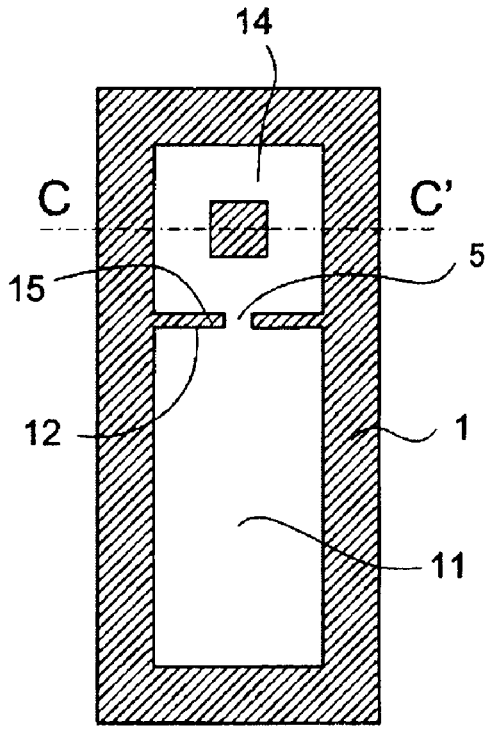
FIG. 8 is a cross sectional view taken along the line B-B', for illustrating the transmission line converter of FIG. 6 according to Embodiment 2 of the present invention.

FIG. 6 is a cross sectional view illustrating a transmission line converter according to Embodiment 2 of the present invention. FIG. 7 is a cross sectional view taken along the line A-A', for illustrating the transmission line converter of FIG. 6 according to Embodiment 2 of the present invention. FIG. 8 is a cross sectional view taken along the line B-B', for illustrating the transmission line converter of FIG. 6 according to Embodiment 2 of the present invention. Note that FIG. 6 corresponds to a cross sectional view of each of FIGS. 7 and 8, which is taken along the line C-C', for illustrating the transmission line converter.

In FIGS. 6 to 8, a metal chassis 1 is formed by joining or bonding a plurality of metal members provided with excavated portions by brazing or diffusion joining, and constitutes the rectangular waveguide 11 (FIGS. 7 and 8) and a rectangular coaxial line 14. A metal wall 15 (FIGS. 7 and 8) separating the rectangular waveguide 11 and the rectangular coaxial line 14 forms the narrow wall surface 12 of the rectangular waveguide 11 and one surface of an outer conductor of the rectangular coaxial line 14. The slot 5 is provided in the metal wall 15.

A structure is obtained in which one end of the rectangular waveguide 11 is short-circuited at a position which is separated approximately ¼ times a guide wavelength of the rectangular waveguide 11 from the position in which the slot 5 is provided. In contrast to this, a structure is obtained in which one end of the rectangular coaxial line 14 is short-circuited at a position which is separated approximately ½ times a propagation wavelength of the rectangular coaxial line 14 from the position in which the slot 5 is provided as depicted in FIGS. 6 and 7.

The slot 5 is formed into a bent shape such that a central portion thereof includes an oblique portion which is not parallel to a tube axis direction of the rectangular waveguide 11 and has a certain angle with respect thereto (that is, a portion in which a central portion crosses the tube axis of rectangular waveguide 11 at an angle which is not zero degrees) and both end portions thereof are parallel to the tube axis direction (see shape of slot 5 which is indicated by broken line of FIG. 6). A total length is approximately ½ times a wavelength.

Next, an operation of the transmission line converter according to Embodiment 2 is described.

The operation for resonating the slot 5 based on the high-frequency signal input to the rectangular waveguide 11 is the same as in Embodiment 1.

In contrast to this, a ground current of the high-frequency signal propagating through the rectangular coaxial line 14 flows parallel to a transmission direction of the rectangular coaxial line 14. One end of the rectangular coaxial line 14 is short-circuited, and hence the current flowing through the outer conductor is maximum in the position of the slot 5 corresponding to the position which is separated approximately ½ times the propagation wavelength from the short-circuited end.

As in the case of FIG. 5 in Embodiment 1, the central portion of the slot 5 blocks the current from flowing through the outer conductor, and hence the high-frequency signal is coupled from the resonant slot 5 to the rectangular coaxial line 14.

Therefore, the high-frequency signal that has propagated through the rectangular waveguide 11 is coupled to the rectangular coaxial line 14 through the slot 5 and thus may propagate through the rectangular coaxial line 14 without reflection.

As described above, according to Embodiment 2, the slot having the bent shape is provided in the position in which the respective currents are maximum on the narrow wall surface of the rectangular waveguide and the ground conductor of the rectangular coaxial line, so as to block the current from flowing through the outer conductor. Therefore, the high-frequency signal is coupled between the rectangular waveguide and the rectangular coaxial line through the slot and thus may propagate without reflection.

With regard to the bent shape of the slot provided in the narrow wall surface of the rectangular waveguide, the central portion includes the oblique portion to the tube axis of the rectangular waveguide and both end portions include portions parallel to the tube axis of the rectangular waveguide, and hence the rectangular coaxial line may be provided on the narrow wall surface of the rectangular waveguide in the tube axis direction. Therefore, as compared with a case where the slot is provided in the rectangular waveguide in a direction perpendicular to an electric field, a small-size transmission line converter may be obtained, in which an area required to provide the slot is reduced.

The example illustrated in FIGS. 6 to 8 in Embodiment 2 of the present invention corresponds to the case where both ends of the slot 5 are bent with respect to the central portion. However, even when only one end is bent to provide the slot parallel to the tube axis direction, the same effect as in the case where both ends are bent may be obtained. The slot 5 may have not only the shape obtained by bending the straight line but also a curved shape.

The definition "the shape in which at least one of the end portions includes the portion parallel to the tube axis of the rectangular waveguide" is not limited to the bending direction of the end portions of the slot as illustrated in FIG. 6. Even when the end portions are bent in opposite directions by 180 degrees (that is, even when end portions are bent such that entire slot is formed into Z-shape), the same effect may be obtained.

An angle of the central portion of the slot with respect to the tube axis direction may be arbitrarily selected within a range of from a value larger than 0 degrees to a value smaller than 180 degrees. When the angle is adjusted depending on the shape of the rectangular waveguide, the shape of the rectangular coaxial line, and impedances of those, impedance matching between the rectangular waveguide and the coaxial line may be realized.

Embodiment 3

Embodiment 1 describes the converter in the case where the microstrip line using one dielectric board is used as the transmission line. In contrast to this, Embodiment 3 of the present invention describes a converter in a case where a strip line using two dielectric boards is used as the transmission line.

Figure 9:
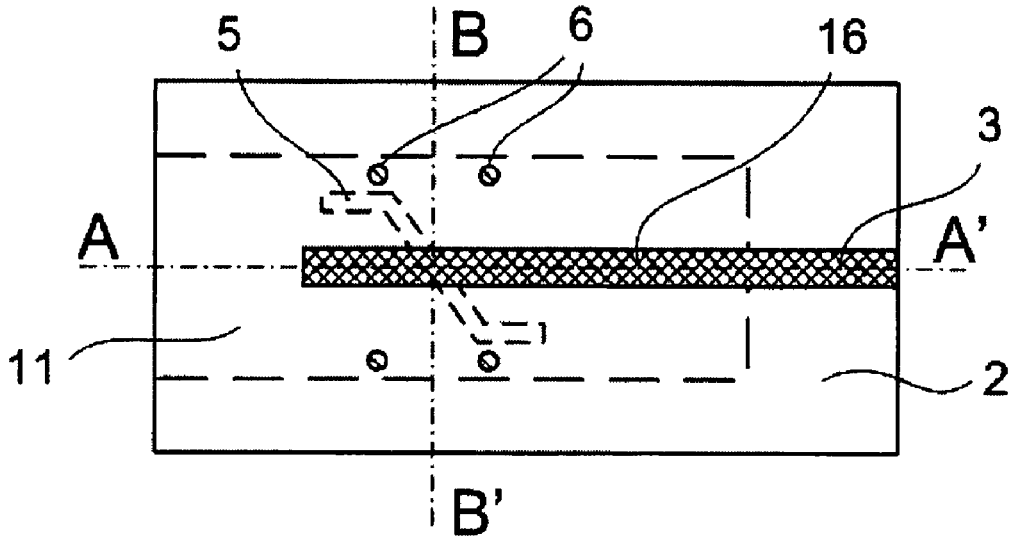
FIG. 9 is a cross sectional view illustrating a transmission line converter according to Embodiment 3 of the present invention.
Figure 10:
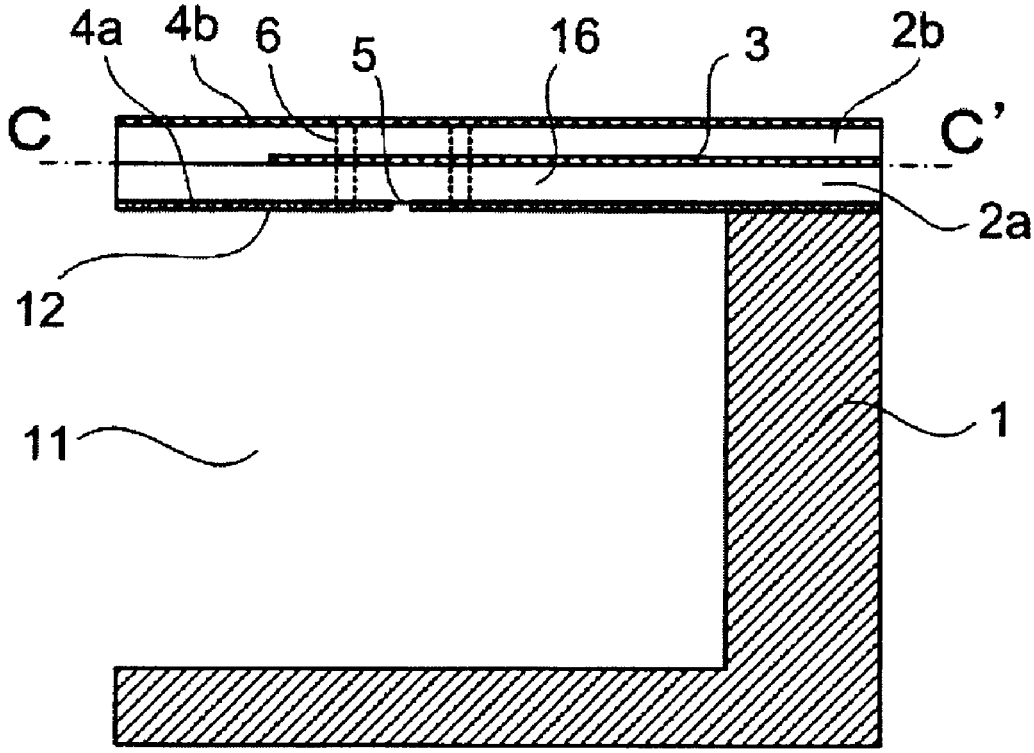
FIG. 10 is a cross sectional view taken along the line A-A', for illustrating the transmission line converter of FIG. 9 according to Embodiment 3 of the present invention.
Figure 11:
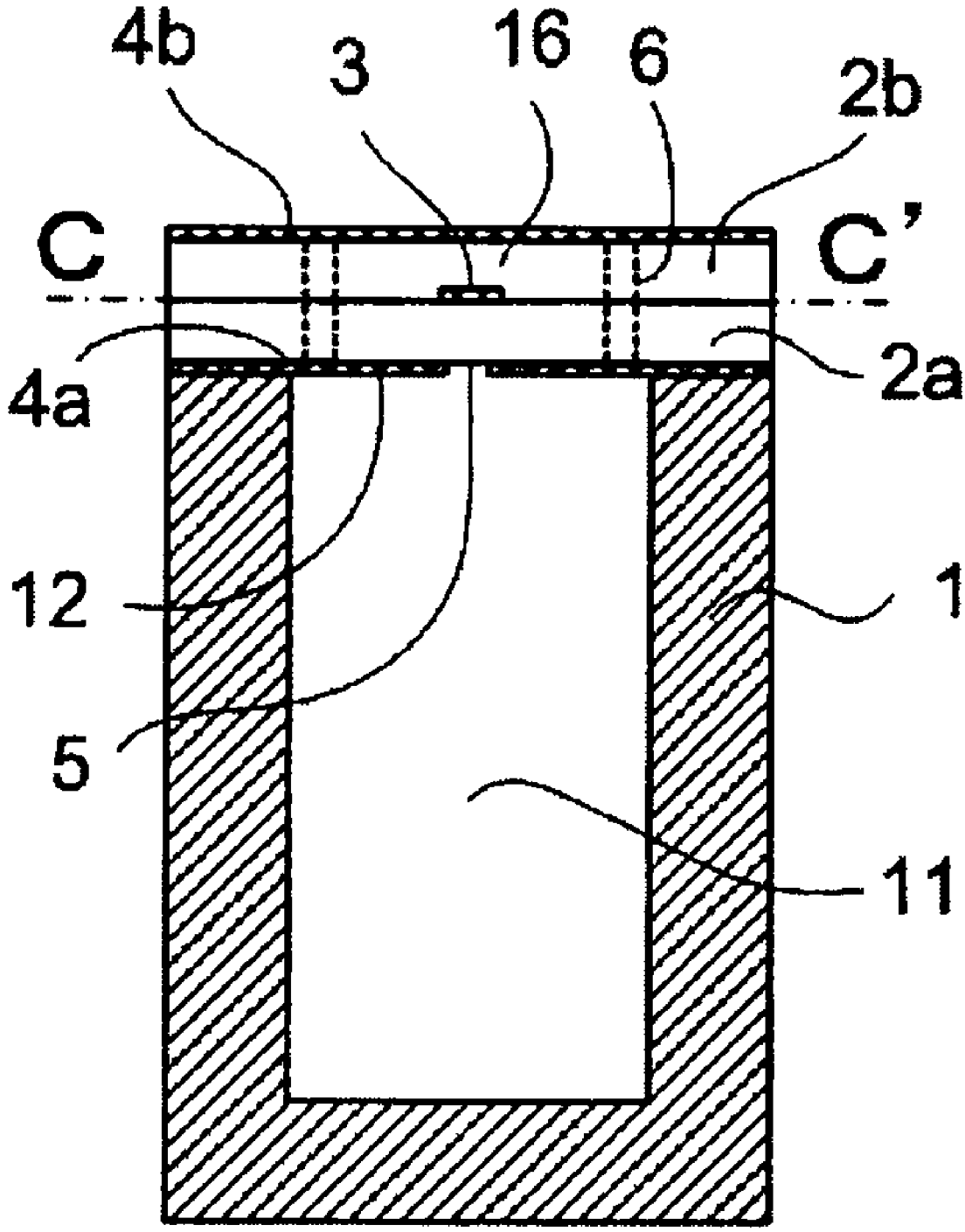
FIG. 11 is a cross sectional view taken along the line B-B', for illustrating the transmission line converter of FIG. 9 according to Embodiment 3 of the present invention.

FIG. 9 is a cross sectional view illustrating a transmission line converter according to Embodiment 3 of the present invention. FIG. 10 is a cross sectional view taken along the line A-A', for illustrating the transmission line converter of FIG. 9 according to Embodiment 3 of the present invention. FIG. 11 is a cross sectional view taken along the line B-B', for illustrating the transmission line converter of FIG. 9 according to Embodiment 3 of the present invention. Note that FIG. 9 corresponds to a cross sectional view of each of FIGS. 10 and 11, which is taken along the line C-C', for illustrating the transmission line converter.

In FIGS. 9 to 11, ground conductor patterns 4*a* and 4*b* are provided on one surfaces of two dielectric boards 2*a* and 2*b*, respectively. The strip conductor pattern 3 is provided on another surface of the dielectric board 2*a* which is opposite to the ground conductor pattern 4*a*. In this way, the two dielectric boards 2*a* and 2*b* are stacked on each other such that the respective ground conductor patterns 4*a* and 4*b* (FIGS. 10 and 11) are located on the outer surfaces of dielectric boards 2*a* and 2*b* that are not in contact with each other, and thus constitute a strip line 16. The ground conductor pattern 4*a* is provided with the slot 5.

The metal chassis 1 (FIGS. 10 and 11) and the dielectric board 2*a* are stacked on each other such that the ground conductor pattern 4*a* is in contact with the metal chassis 1, and thus constitute the rectangular waveguide 11. The ground conductor pattern 4*a* forms the narrow wall surface 12 (FIGS. 10 and 11) of the rectangular waveguide 11. In order to connect the ground conductor patterns 4*a* and 4*b* to each other, through holes 6 are provided in the dielectric boards 2*a* and 2*b*.

A structure is obtained in which one end of the rectangular waveguide 11 is short-circuited at a position which is separated approximately ¼ times a guide wavelength of the rectangular waveguide 11 from the position in which the slot 5 is provided. In contrast to this, a structure is obtained in which one end of the strip line 16 is open-circuited at a position which is separated approximately ¼ times a propagation wavelength of the strip line 16 from the position in which the slot 5 is provided.

The slot 5 is formed into a bent shape such that a central portion thereof includes an oblique portion which is not parallel to a tube axis direction of the rectangular waveguide 11 and has a certain angle with respect thereto (that is, portion in which central portion crosses tube axis of rectangular waveguide 11 at an angle which is not zero degrees) and both end portions thereof are parallel to the tube axis direction (see shape of slot 5 which is indicated by broken line of FIG. 9). A length of the entire slot 5 is approximately ½ times a wavelength.

The through holes 6 are provided around the slot 5 at an interval smaller than ½ of a propagation wavelength in the dielectric boards 2*a* and 2*b*.

Next, an operation of the transmission line converter according to Embodiment 3 is described.

The operation for resonating the slot 5 based on the high-frequency signal input to the rectangular waveguide 11 is the same as in Embodiments 1 and 2.

On the other hand, a ground current of the high-frequency signal propagating through the strip line 16 flows parallel to a transmission direction of the strip line 16. One end of the strip line 16 is open-circuited, and hence the current flowing through the ground conductor pattern 4*a* is maximum in the position of the slot 5 corresponding to the position which is separated approximately ¼ times the propagation wavelength from the open end.

As in the case of FIG. 5 in Embodiment 1, the central portion of the slot 5 blocks a current from flowing through the ground conductor pattern 4*a*, and hence the high-frequency signal is coupled from the resonant slot 5 to the strip line 16. In this case, the current flowing through the ground conductor pattern 4*a* flows also into the ground conductor pattern 4*b* through the through holes 6. Therefore, the high-frequency signal may be propagated to the strip line 16.

Therefore, the high-frequency signal that has propagated through the rectangular waveguide 11 is coupled to the strip line 16 through the slot 5 and thus may propagate through the strip line 16 without reflection.

As described above, according to Embodiment 3, the slot having the bent shape is provided in the position in which the respective currents are maximum on the narrow wall surface of the rectangular waveguide and the ground conductor pattern of the strip line, so as to block both the currents. In addition, the through holes for connecting the upper and lower ground conductors of the strip line are provided close to the slot. Therefore, the high-frequency signal is coupled between the rectangular waveguide and the strip line through the slot and thus may propagate without reflection.

With regard to the bent shape of the slot provided in the narrow wall surface of the rectangular waveguide, the central portion includes the oblique portion to the tube axis of the rectangular waveguide and both end portions include portions parallel to the tube axis of the rectangular waveguide, and hence the strip line may be provided on the narrow wall surface of the rectangular waveguide in the tube axis direction. Therefore, as compared with a case where the slot is provided in the rectangular waveguide in a direction perpendicular to an electric field, a small-size transmission line converter may be obtained in which an area required to provide the slot is reduced.

The example illustrated in FIGS. 9 to 11 in Embodiment 3 of the present invention corresponds to the case where both ends of the slot 5 are bent with respect to the central portion. However, even when only one end is bent to provide the slot parallel to the tube axis direction, the same effect as in the case where both ends are bent may be obtained. The slot 5 may have not only the shape obtained by bending the straight line but also a curved shape.

The definition "the shape in which at least one of the end portions includes the portion parallel to the tube axis of the rectangular waveguide" is not limited to the bending direction of the end portions of the slot as illustrated in FIG. 9. Even when the end portions are bent in opposite directions by 180 degrees (that is, even when end portions are bent such that entire slot is formed into Z-shape), the same effect may be obtained.

An angle of the central portion of the slot with respect to the tube axis direction may be arbitrarily selected within a range of from a value larger than 0 degrees to a value smaller than 180 degrees. When the angle is adjusted depending on the shape and impedance of the rectangular waveguide, as well as the shape and impedance of the strip line, impedance matching between the rectangular waveguide and the strip line may be realized.

The case where the microstrip line is used in Embodiment 1, the case where the coaxial line is used in Embodiment 2, and the case where the strip line is used in Embodiment 3 are described as the specific examples of the transmission lines. However, the present invention is not limited to the transmission line configurations described with respect to Embodiments 1, 2, and 3. Any of the transmission lines including the microstrip line, the coaxial line, and the strip line may be applied to all the structures according to Embodiments 1 to 3, and the same effect may be obtained.

The invention claimed is:

1. A transmission line converter, comprising:

a rectangular waveguide;

a slot provided in a wall surface of the rectangular waveguide; and a transmission line which extends in a direction of a tube axis of the rectangular waveguide and includes a signal conductor and a ground conductor, wherein the slot is provided in the wall surface with a narrowest width, of the rectangular waveguide, has a shape in which a central portion of the slot includes an oblique portion to the tube axis of the rectangular waveguide, and at least one end portion of the oblique portion includes a portion parallel to the tube axis of the rectangular waveguide, wherein the wall surface of the rectangular waveguide in which the slot is provided is a part of the ground conductor, wherein the transmission line includes one end that is open-circuited at a position which is separated by approximately ¼ times a propagation wavelength in the transmission line from the slot.

2. The transmission line converter according to claim 1, wherein the transmission line is a microstrip line.

3. A transmission line converter, comprising:

a rectangular waveguide;

a slot provided in a wall surface of the rectangular waveguide; and a transmission line which extends in a direction of a tube axis of the rectangular waveguide and includes a signal conductor and a ground conductor, wherein the slot is provided in the wall surface with a narrowest width, of the rectangular waveguide, has a shape in which a central portion of the slot includes an oblique portion to the tube axis of the rectangular waveguide, and at least one end portion of the oblique portion includes a portion parallel to the tube axis of the rectangular waveguide, wherein the wall surface of the rectangular waveguide in which the slot is provided is a part of the ground conductor, wherein the transmission line includes one end short-circuited at a position which is separated by approximately ½ times a propagation wavelength in the transmission line from the slot.

4. The transmission line converter according to claim 3, wherein the transmission line is a coaxial line.

5. The transmission line converter according to claim 4, further comprising:

a metal wall that separates the rectangular waveguide and the coaxial line, wherein the metal wall forms the wall surface with the narrowest width.

6. A transmission line converter, comprising:

a rectangular waveguide;

a slot provided in a wall surface of the rectangular waveguide; and a transmission line which extends in a direction of a tube axis of the rectangular waveguide and includes a signal conductor and a ground conductor, wherein the slot is provided in the wall surface with a narrowest width, of the rectangular waveguide, has a shape in which a central portion of the slot includes an oblique portion to the tube axis of the rectangular waveguide, and at least one end portion of the oblique portion includes a portion parallel to the tube axis of the rectangular waveguide, wherein the wall surface of the rectangular waveguide in which the slot is provided is a part of the ground conductor, wherein the rectangular waveguide includes one end short-circuited at a position which is separated by approximately ¼ times a guide wavelength in the rectangular waveguide from the slot.

7. The transmission line converter according to claim 6, wherein the transmission is a strip line.

8. The transmission line converter according to claim 6, wherein through holes are provided in the wall surface with the narrowest width and are spaced at an interval of less than ½ times a propagation wavelength in a dielectric board of the transmission line.

* * * * *